US005079564A

United States Patent [19]

Sasaki et al.

[11] Patent Number: 5,079,564

[45] Date of Patent: Jan. 7, 1992

[54] RECORDING APPARATUS USING A TIME VARYING DISTRIBUTION OF HEAT ELEMENT DRIVING PULSES

[75] Inventors: Eiichi Sasaki, Yokohama; Takashi Mori, Tokyo, both of Japan

[73] Assignee: Ricoh Company, Ltd., Tokyo, Japan

[21] Appl. No.: 431,757

[22] Filed: Nov. 6, 1989

[30] Foreign Application Priority Data

Nov. 11, 1988 [JP] Japan ..... 63-285000
Jan. 17, 1989 [JP] Japan ..... 1-7972
Apr. 24, 1989 [JP] Japan ..... 1-104093

[51] Int. Cl.[5] ..... B41J 2/315
[52] U.S. Cl. ..... 346/76 PH; 358/298
[58] Field of Search ..... 366/76 PH; 358/298

[56] References Cited

U.S. PATENT DOCUMENTS 4,395,146 7/1983 Arai ..... 346/76 PH
4,492,482 1/1985 Eguchi et al. ..... 346/76 PH
4,621,271 11/1986 Brownstein ..... 346/76 PH
4,691,211 9/1987 Brownstein ..... 346/76 PH
4,745,413 5/1988 Brownstein ..... 346/76 PH
4,899,170 2/1990 Izumi ..... 346/76 PH

FOREIGN PATENT DOCUMENTS 2924178 6/1979 European Pat. Off. .
3327904 2/1983 European Pat. Off. .

*Primary Examiner*—Benjamin R. Fuller
*Assistant Examiner*—Huan Tran
*Attorney, Agent, or Firm*—Cooper & Dunham

[57] ABSTRACT

A recording apparatus comprising a recording head having a recording unit. At least two pulses are applied to the recording unit to form one picture element. The apparatus comprises a pulse diffusion means for diffusing the pulses to be applied to the recording unit within an image record time for recording one line of the picture element.

6 Claims, 12 Drawing Sheets

RECORDING APPARATUS USING A TIME VARYING DISTRIBUTION OF HEAT ELEMENT DRIVING PULSES

BACKGROUND OF THE INVENTION

The present invention relates to a recording apparatus which forms a picture element (pixel or PEL) by applying at least one or more pulses to a recording element disposed on a recording head. More particularly, the invention relates to a thermal head driving apparatus applied to a unit equiped with a thermal head, such as a printer, a facsimile, and a copying apparatus.

Generally, a sublimation type thermal printer comprises a thermal head having a recording unit which comprises a plurality of heating resistor elements arranged in a line. An image recording function such as printing or copying function is conducted by applying pulses to each of the heating resistor elements. In a multi-gradation-image recording apparatus, dot gradations are controlled by changing the length of the pulse applied to the heating resistor elements. The number of the heating resistor elements is the same as that of the dots (picture elements) which constitutes one picture element line. An image is formed on a record paper by selectively actuating the dots in the line while moving the record paper line by line.

In such a sublimation type thermal printer, heat value of each dot distributes unevenly in one picture element line due to unevenness of resistance value of each of the heat resistor elements.

In order to compensate for the unevenness of heat value of each resistor element, the heating resistor elements are classified in groups according to the resistance value of each element so that the time period for applying the pulse to the heating resistor elements is changed in accordance with the classified group. Such compensation is proposed in Japanese Patent Application Laying Open (Kokai) No. 59-45176.

Also, in general, a current applying and transferring type printer comprises a recording head comprising a recording unit having recording electrodes and common electrodes. The recording unit is urged against an ink sheet which comprises a resistance layer, a conductive layer and an ink layer of a melting type ink or a sublimation type ink. An electric current is applied to the ink sheet from the recording electrodes and the common electrodes so as to generate a Joule heat on the resistance layer of the ink sheet so that the ink is selectively transferred to the record paper.

Generally, the above-mentioned recording electrodes are formed on a ceramic substrate by a plating method which limits the electrode layer to approximately 70 μm in thickness. The recording head is actually inclined with respect to the ink sheet when the head comes in contact with the ink sheet. Therefore, the width of the recording electrode actually in contact with the ink sheet is approximately 100 μm. Appropriate thickness of the recording electrode is about 10 μm to 30 μm since accuracy of the positioning of the recording electrodes is degraded and the electrode layer becomes easy to be removed when the electrode thickness exceeds the above-mentioned appropriate range.

As a result, the area of the recording electrode coming in contact with the ink sheet can be relatively small, such as 140 μm×30 μm actually, although a desired area is 167 μm×167 μm with respect to the recording head having a picture element density of 6 dot/mm, for instance.

A way to widen the contacting area of the recording electrode for forming a picture element is to continuously move the recording electrodes and the ink sheet while applying current to the ink sheet from the recording electrodes and the common electrodes. Also, in the multi-gradation image recording system, the pulse width or the number of the pulses applied from the recording electrodes and the common electrodes to the ink sheet is changed in response to the density of the picture element.

In the multi-gradation printing operation using the above-mentioned sublimation type thermal printer, the dot gradation (density) is controlled by charging the width of the pulse applied to the heat resistor element. That is, when the dots are to be recorded in low density, a short pulse is applied to the heating resistors of the thermal head while moving the record paper, whereas when the dots are to be recorded in a high density, a long pulse is applied to the heating resistors. Therefore, the ending point of the high density dot is moved so that the center point thereof differs from that of the low density dot, which degrades the quality of the record image. Also, in the low density dot portion where white background is dominant, the image can have a rough appearance and high frequency effects may appear due to interaction from the high density dots, which can further degrades the quality of the recorded image.

When compensating for the uneven resistance value of the heating resistors by classifying them into a plurality of groups of a different resistance value, the time period for applying pulse is changed in accordance with the group. In accordance with this grouping compensation method, the pulse width of the pulse for the low resistance heating resistors is shorter than that for the high resistance heating resistors. Therefore, the dot size of the low resistance heating resistor element is smaller than that of the high resistance heating resistor element. Therefore, the white background portion becomes wide when the low resistance heating resistor elements are used to form dots. In order to even the dot density over the record paper, the pulses are applied to the heating resistor elements in such a way that the temperature of the low resistance heating resistor elements is higher than that of the high resistance heating resistor elements. Therefore, the service life of the low resistance heating resistor elements is shortened due to the high temperature operation thereof. Besides, uneven density portions are newly formed due to heat accumulated in the elements during the dot forming operation for the previous line.

Also, when a synthetic paper or an OHP paper can be used as the record paper, the paper is deformed and can lose luster from the surface thereof due to the high temperature of the low resistance heating resistor elements. Besides, a specific heat resistance treatment must be executed to the substrate of the ink sheet to cope with the high temperature from the low resistance heating resistor elements.

The ink color development is largely influenced by the heat diffusion time of the heat resistor elements especially in a high speed recording operation. Therefore, when the temperature of the low resistance heating resistors is raised in a short time, the ink may not be fully developed on the printing paper.

Also, in the multi-gradation image recording operation of the above-mentioned current applying and transferring type printer, the image could appear to be rough because the size of the picture element of the image is not even for each gradation and therefore the white background portion can be overemphasized in the low density portion of the recorded image.

SUMMARY OF THE INVENTION

It is therefore an object of the present invention to provide a recording apparatus in which the above-mentioned drawbacks are obviated so that the quality of the record image is upgraded without rising the temperature of the heating resistor elements of the recording unit.

The object of the invention mentioned above can be achieved by a recording apparatus comprising a recording head having a recording unit to which at least two pulses are applied to form one picture element, wherein the apparatus comprises a pulse diffusion means for diffusing the pulses to be applied to the recording unit within an image record time for recording one line of the picture element.

In accordance with the above-mentioned structure of the present invention, the pulses to be applied to the recording unit are diffused in an image recording time for recording one line of a picture element by the pulse diffusion means.

Advantages of the above-mentioned recording apparatus are that the quality of the record image is upgraded and that it becomes unnecessary to raise the temperature of the recording unit since the apparatus comprises the pulse diffusion means for diffusing the pulses to be applied to the recording unit within an image record time for recording one line of a picture element.

The above-mentioned object of the invention can also be achieved by an embodiment of the invention comprising a thermal head which comprises a plurality of heating resistor elements disposed in one line, each element forming one dot, and a thermal head driving unit which comprises a heat value control means for controlling the heat value of the heating resistor elements by applying a plurality of pulses to each dot of the heating resistor elements and changing the number of the pulses, wherein the apparatus further comprises a pulse diffusion means for diffusing the pulses in an image record time for forming one line of the dots which pulses are to be applied to each dot of the heating resistor elements.

In accordance with the above-mentioned structure, a plurality of pulses to be applied to each dot of the heating resistor elements are diffused in an image record time for forming one line of the dots.

Advantages of the above-mentioned structure are that the quality of the record image is upgraded and that it becomes unnecessary to raise the temperature of the heating resistor elements having a low resistance value since the above-mentioned apparatus structure comprises a thermal head which comprises a plurality of heating resistor elements disposed in one line, each element forming one dot, and a thermal head driving unit which comprises a heat value control means for controlling the heat value of the heating resistor elements by applying a plurality of pulses to each dot of the heating resistor elements and changing the number of the pulses, wherein the apparatus further comprises a pulse diffusion means for diffusing the pulses in an image record time for forming one line of the dots which pulses are to be applied to each dot of the heating resistor elements.

The object of the invention mentioned before can also be achieved by another recording apparatus embodiment of the present invention which in addition to the above-mentioned structure comprises a block switching means which divides the plurality of heating resistor elements into at least two blocks and applies the pulses to the heating resistor elements in such a way that each pulse is applied to a different block by switching the block for each pulse.

In accordance with the above-mentioned structure, due to the function of the block switching means, the pulses are applied to the heating resistor elements in such a way that each pulse is applied to a different block by switching the block for each pulse.

Also, the above-mentioned structure can be used as a thermal head driving unit comprising a block switching means which divides the plurality of heating resistor elements disposed in the thermal head into at least two blocks and applies pulses to the heating resistor elements in such a way that each pulse is applied to a block different from the block to which a previous pulse is applied by switching the block for each pulse.

The object of the present invention mentioned above can also be achieved by a still another recording apparatus embodiment of the present invention comprising a thermal head which comprises a plurality of heating resistor elements disposed in one line, each element forming one dot, and a heat value control means for controlling the heat value of the heating resistor elements by applying a plurality of pulses to each dot of the heating resistor elements and changing the number of the pulses, wherein the apparatus further comprises a pulse control means which controls the pulses in such a way that the pulses are applied densely in an early part of an image printing time for printing one line of the dots while the pulses are diffused and sparsely applied in a later part of the image printing time.

In accordance with the above-mentioned structure, the plurality of pulses to be applied to each dot of the heating resistor elements are controlled in such a way that the pulses are applied densely in an early part of an image printing time for printing one line of the dots while the pulses are diffused and sparsely applied in a later part of the image printing time.

Advantages of the above-mentioned structure are that the quality of the image is upgraded, that it becomes unnecessary to raise the temperature of the heating resistor elements having a low resistance value and that it becomes possible to rapidly raise the temperature of the heating resistor elements, since the apparatus comprises a thermal head which comprises a plurality of heating resistor elements disposed in one line, each element forming one dot, and a heat value control means for controlling the heat value of the heating resistor elements by applying a plurality of pulses to each dot of the heating resistor elements and changing the number of the pulses, wherein the apparatus further comprises a pulse control means which controls the pulses in such a way that the pulses are applied densely in an early part of an image printing time for printing one line of the dots while the pulses are diffused and sparsely applied in a later part of the image printing time.

Further objects and advantages of the present invention will be apparent from the following description of the preferred embodiments of the invention as illustrated in the accompanying drawings.

DESCRIPTION OF THE PREFERRED EMBODIMENTS

Embodiments of the present invention are described hereinafter in detail in comparison to the prior art with reference to the drawings.

Figure 21:
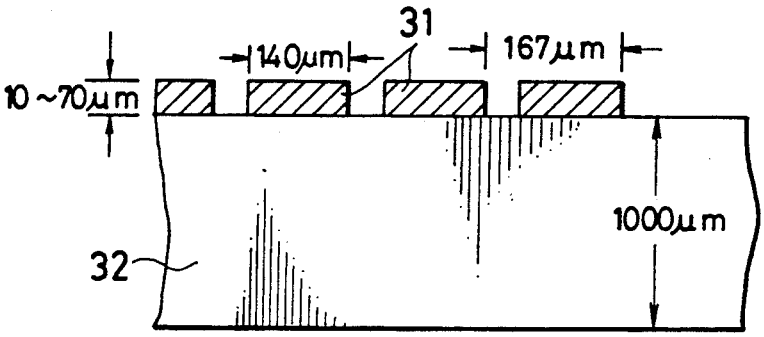
FIG. 21 is a sectional side view of a part of the current applying and transferring head.
Figure 22:
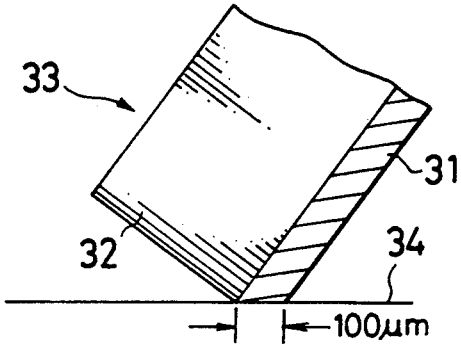
FIG. 22 is an explanatory view for explaining a situation in which the current applying and transferring head comes in contact with the ink sheet.

Generally, as illustrated in FIG. 21, the recording electrodes mentioned before are formed on a ceramic substrate by a plating method which limits the thickness of the electrode layer to approximately 70 μm. The recording head 33 is actually inclined with respect to the ink sheet 34 when the head comes in contact with the ink sheet 34, as illustrated in FIG. 22. Therefore, the width of the recording electrode 31 actually in contact with the ink sheet 34 is approximately 100 μm. Appropriate thickness of the recording electrode is about 10 μm to 30 μm since accuracy of the positioning of the recording electrodes 31 is degraded and the electrode layer becomes easy to be removed when the electrode thickness exceeds the above-mentioned appropriate range.

As a result, the area of the recording electrode 31 coming in contact with the ink sheet 34 can be relatively small, such as 140 μm×30 μm actually, although a desired area is 167 μm×167 μm with respect to the recording head having a picture element density of 6 dot/mm, for instance.

Figure 23A:
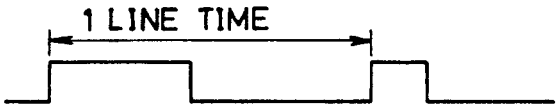
FIG. 23*a* is a schematic diagram for representing a change of pulse waveform in a multi-gradation printing operation in accordance with the prior art.
Figure 23B:
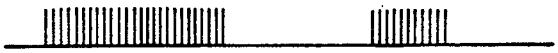
FIG. 23*b* is a schematic diagram for representing a change of pulse number in the multigradation printing operation in accordance with the prior art.

A way to widen the contacting area of the recording electrode for forming a picture element is to continuously move the recording electrodes and the ink sheet while applying current to the ink sheet from the recording electrodes and the common electrodes. Also, in the multi-gradation image recording system, the pulse width of the pulses applied from the recording electrodes and the common electrodes to the ink sheet is changed in response to the density of the picture element, as illustrated in FIG. 23*a*, or the number of the pulses applied from the recording electrodes and the common electrodes to the ink sheet is changed in response to the density of the picture element, as illustrated in FIG. 23*b*.

Figure 11:
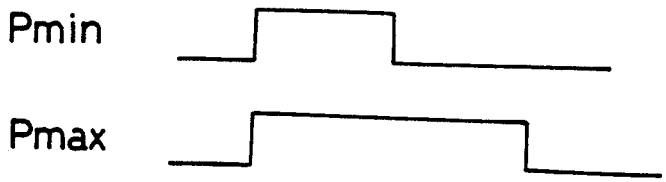
FIG. 11 is an explanatory diagram for representing waveforms of pulses applied to the heating resistor elements in accordance with a prior art.
Figure 12:
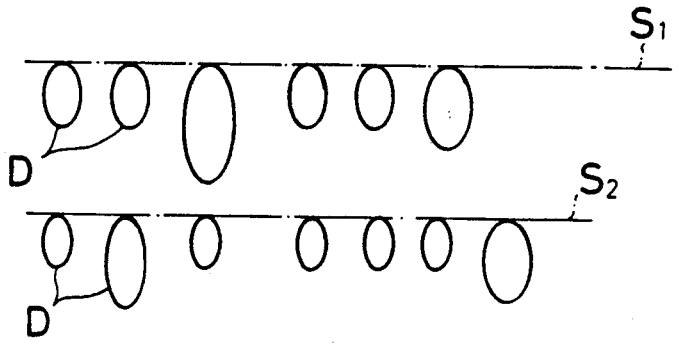
FIG. 12 is an explanatory diagram for representing a relation between the heating resistor element and a pulse applied thereto in accordance with the prior art.

In the multi-gradation printing operation using the above-mentioned sublimation type thermal printer, the dot gradation (density) is controlled by changing the width of the pulse applied to the heating resistor element. That is, as illustrated in FIG. 11, when the dots are to be recorded in low density, a short pulse Pmin is applied to the heating resistors of the thermal head while moving the record paper, whereas when the dots are to be recorded in high density, a long pulse Pmax is applied to the heating resistor elements. Therefore, although a start line S1, S2, . . . for starting to form each row of dots D is the same for the dots in the row, as illustrated in FIG. 12, the ending point of the high density or dark dot is elongated so that the center point thereof differs from that of the low density or light dot, which degrades the quality of the record image. Also, in the low density dot portion where white grounds are dominant, the image is rough and high frequency due to the interaction between the high and low density dots, which further degrades the quality of the record image.

Figure 13:
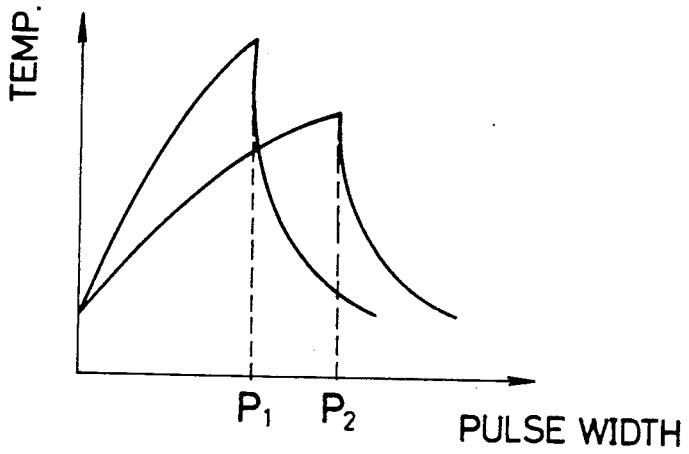
FIG. 13 is a graphical diagram for representing a characteristic relation between the pulse width applied to the heating resistor elements and temperature in accordance with the prior art.
Figure 14:
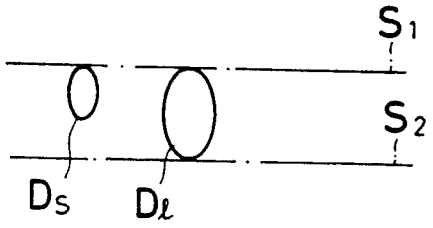
FIG. 14 is an explanatory diagram for representing recording dots in accordance with the prior art.

With respect to the way for compensation for the uneven resistance value of the heating resistors by classifying them into a plurality of groups of a different resistance value, the time period for applying pulse is changed in accordance with the group. In accordance with this grouping compensation method, the pulse width P1 of the pulse for the low resistance heating resistor elements is shorter than the pulse width P2 for the high resistance heating resistor elements, as illustrated in FIG. 13. Therefore, the dot size Ds of the low resistance heating resistor element is smaller than the dot size D1 of the high resistance heating resistor element, as illustrated in FIG. 14. Therefore, the white ground portion becomes wide when the low resistance heating resistor elements (dots Ds) are used to form dots. In order to even the dot density over the record paper, the pulses are applied to the heating resistor elements in such a way that the temperature of the low resistance heating resistor elements is higher than that of the high resistance heating resistor elements. Therefore, the service life of the low resistance heating resistor elements is shortened due to the high temperature operation thereof. Besides, uneven density portions are newly formed due to heat accumulated in the elements during the dot forming operation for the previous line.

Also, when a synthetic paper or an OHP paper is used as the record paper, the paper is deformed and luses luster from the surface thereof due to the high temperature of the low resistance heating resistor elements. Besides, a specific heat resistance treatment must be executed to the substrate of the ink sheet to cope with the high temperature from the low resistance heating resistor elements.

The ink color development is largely influenced by the heat diffusion time of the heat resistor elements especially in a high speed recording operation. Therefore, when the temperature of the low resistance heating resistors is risen in a short time, the ink is not fully developed on the printing paper.

Figure 24:
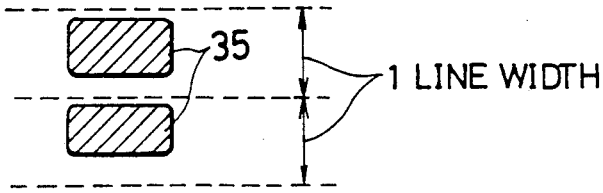
FIG. 24 is a schematic diagram for representing picture elements of the image in accordance with the prior art.

Also, in the multi-gradation image recording operation of the above-mentioned current applying and transferring type printer, since the size of the picture elements 35 of the image are not the same for each gradation, as illustrated in FIG. 24, so that the white ground portion is stressed in the low density portion and the record image becomes to appear rough.

An embodiment of the present invention described below obviates the above-mentioned drawbacks so that the quality of the record image is upgraded without rising the temperature of the heating resistor elements of the recording unit.

Figure 5:
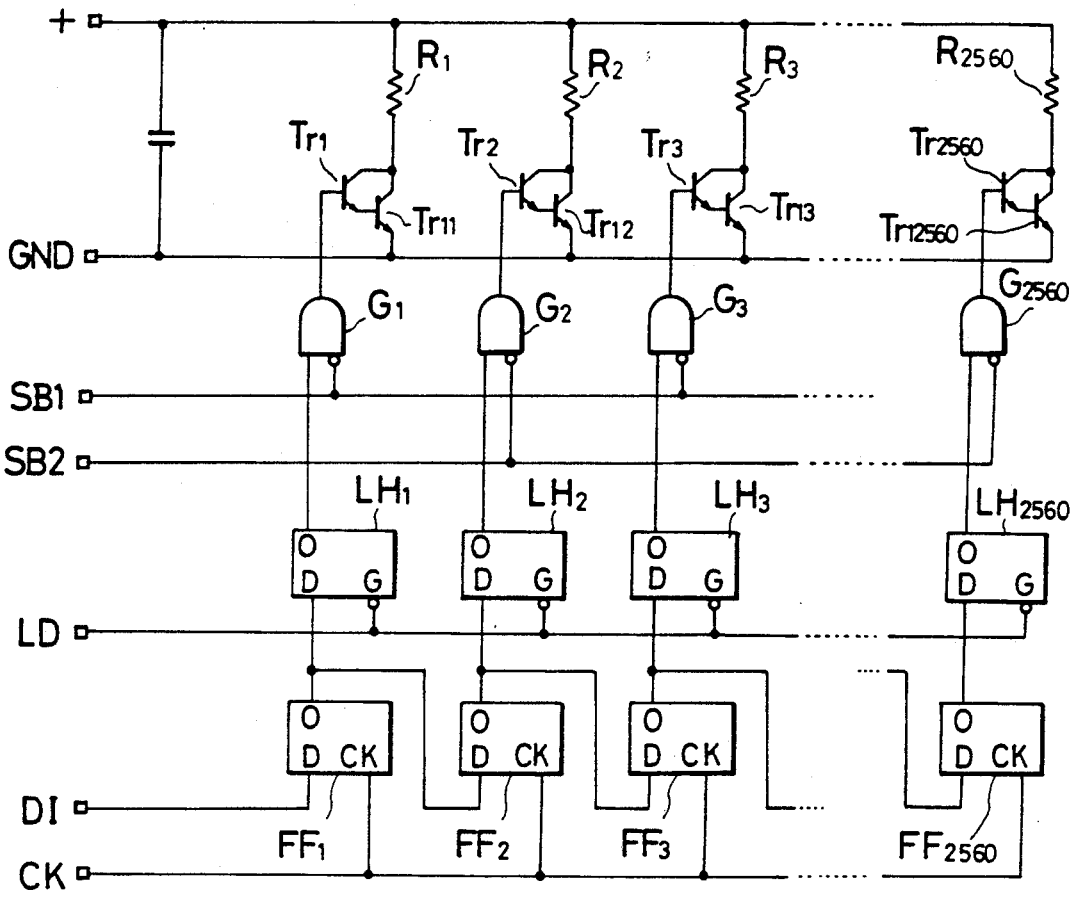
FIG. 5 is a circuit diagram of a thermal head arranged in the embodiment of FIG. 1.

FIG. 5 illustrates an example of circuit construction of a thermal head in accordance with an embodiment of the present invention.

This embodiment represents a thermal head disposed in a sublimation type thermal printer. The thermal head comprises a plurality of recording elements $R_1$ to $R_{2560}$ composed of heating resistor elements each of which corresponds to and forms one of dots arranged in one line. The number of the heating resistor elements is equal to that of dots constituting one line. The heating resistor elements $R_1$ to $R_{2560}$ are disposed in one line in a main (horizontal) scanning direction so as to record or print an image on a record paper line by line according as the paper is shifted in a sub-scanning (vertical scanning) direction.

D-flip-flops $FF_1$ to $FF_{2560}$ constitute a shift register which takes in an image data DI of one line in accordance with a signal from a clock CK. Latch circuits $LH_1$ to $LH_{2560}$ latch the image data DI of one line transmitted from the shift register in accordance with a latch signal LD.

The heating resistor elements $R_1$ to $R_{2560}$ are divided to two groups, i.e., a first group of odd numbered heating resistor elements and a second group of even numbered heating resistor elements.

A first strobe pulse signal SB1 switches on odd numbered gate circuits $G_1, G_3, \ldots, G_{2559}$ so that the image data output from the odd numbered latch circuits $LH_1, LH_3, \ldots, LH_{2559}$ are transmitted to bases of odd numbered transistor circuits $Tr_1, Tr_3, \ldots, Tr_{2559}$ through the odd numbered gate circuits $G_1, G_3, \ldots, G_{2559}$.

A second strobe pulse signal SB2 switches on even numbered gate circuits $G_2, G_4, \ldots, G_{2560}$ so that the image data output from the even numbered latch circuits $LH_2, LH_4, \ldots, LH_{2560}$ are transmitted to bases of even numbered transistor circuits $Tr_2, Tr_4, \ldots, Tr_{2560}$ through the even numbered gate circuits $G_2, G_4, \ldots, G_{2560}$.

When the transistors $Tr_1$ to $Tr_{2560}$ and $Tr_{11}$ to $Tr_{12560}$ are switched on in accordance with the image data, the heating resistor elements $R_1$ to $R_{2560}$ is supplied with a predetermined voltage from a DC power source and generates heat so that a heat sensitive paper or an ink sheet is heated, whereby an image is recorded line by line on the paper according as the paper is shifted.

Figure 6:
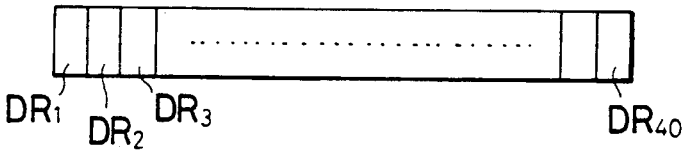
FIG. 6 is a block diagram of a driver of the thermal head of FIG. 5.

It is to be noted that the above-mentioned D-flip-flop circuits $FF_1$ to $FF_{2560}$, the latch circuits $LH_1$ to $LH_{2560}$, the gate circuits $G_1$ to $G_{2560}$ and the transistor circuits $Tr_1$ to $Tr_{2560}$ and $Tr_{11}$ to $Tr_{12560}$ constitute a driver circuit composed of 40 driver chips $DR_1$ to $DR_{40}$, as illustrated in FIG. 6. Each of the 40 driver chips $DR_1$ to $DR_{40}$ is constituted from 64 bits.

Figure 1:
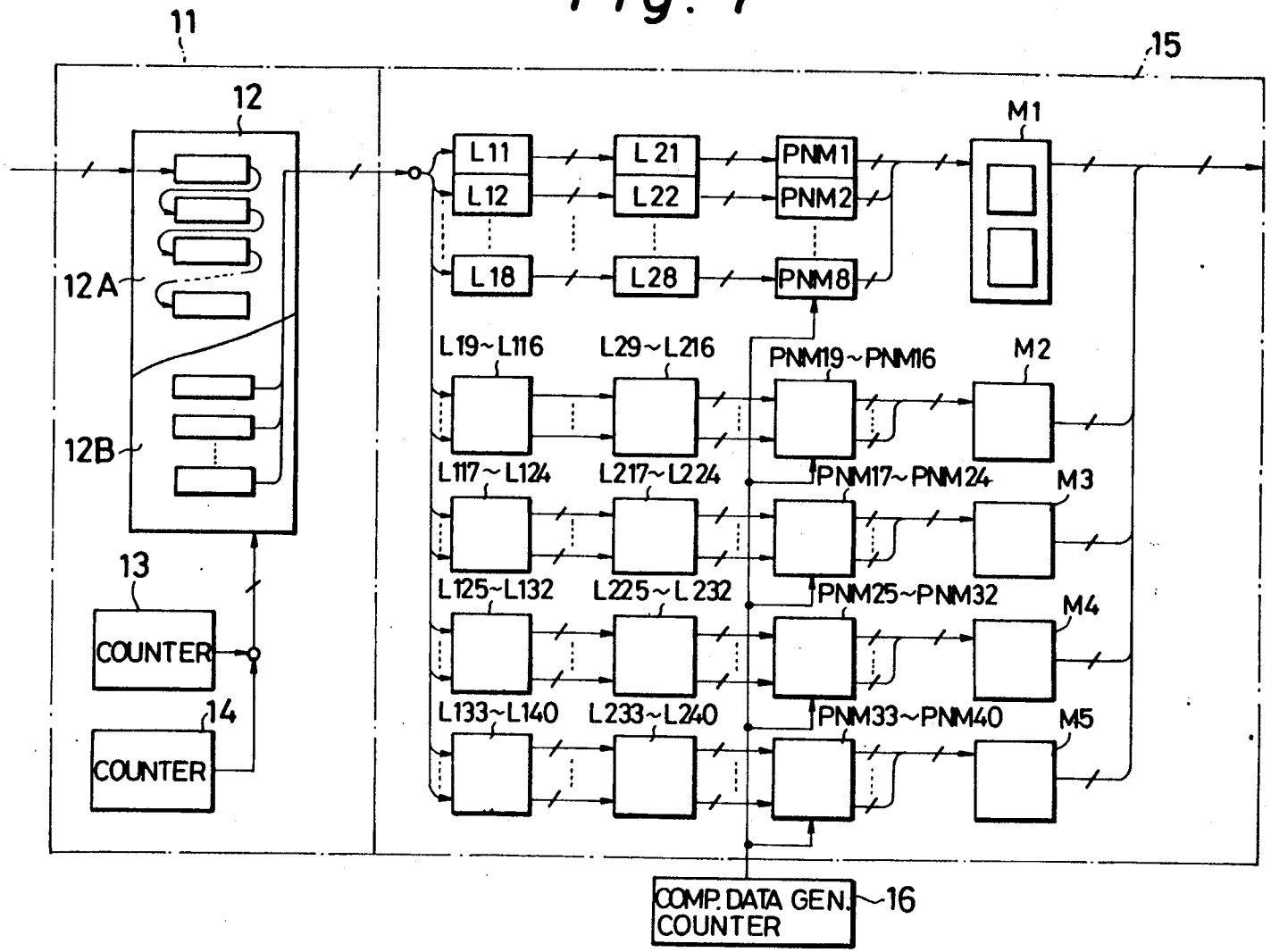
FIG. 1 is a block diagram representing a line buffer circuit, a data converter circuit and a comparison data generation counter in accordance with an embodiment of the present invention.

FIG. 1 illustrates a line buffer 11, a data converter portion 15 and a comparison data generation counter 16 arranged in the above-mentioned embodiment.

The line buffer 11 comprises a line memory circuit 12 and two counter circuits 13 and 14. The line memory circuit 12 is divided to two areas 12A and 12B each of which comprises 4K byte. The memory areas are interchanged by a line synchronizing signal. The counter 13 is a writing counter and the counter 14 is a reading counter. An initial count number of each of the counters 13 and 14 is arranged as 2559. The counters 13 and 14 count down the number each time the image data of multi-gradation is written in the memory 12 or read from the memory. When the count number reaches to zero, the image data is not written in the memory 12.

The outputs from the counters 13 and 14 are interchanged by a READ/WRITE mode signal and alternately output therefrom.

Figure 2:
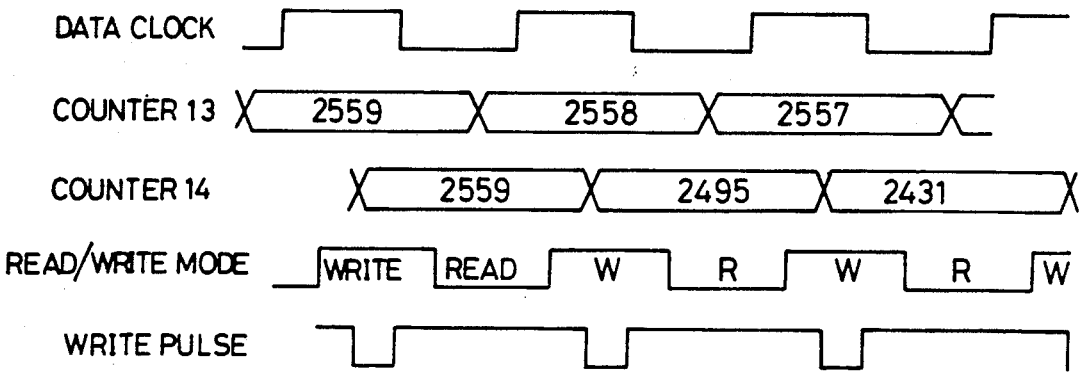
FIG. 2 is a timing chart of functions of the line buffer of FIG. 1.

As represented in FIG. 2, the multi-gradation image data are written in the memory addresses of the memory 12 in sequence decreasing the address number one by one as 2559, 2558, . . . , 0. Whereas the memorized image data are read from the memory addresses of the memory 12 at a regular interval of 64 address numbers, as 2559, 2495, . . . , 63, 2558, 2494, . . . , 62, . . . , 0. This is because each of the drivers $DR_1$ to $DR_{40}$ is constituted by 64 bits.

The image data to be memorized in the memory 12 can be compensated for by a compensation circuit prior to being input to the memory 12 so as to even the heat value from the heating resistor elements $R_1$ to $R_{2560}$ by compensating for the unevenness of the resistance value of the heating resistor elements.

The data converter portion 15 comprises a first step latch circuits L11 to L140, a second step latch circuits L21 to L240, PNM (Pulse Number Module) circuits PNM1 to PNM40 each composed of a magnitude comparator, and head memories M1 to M5. The converter portion 15 functions as follows.

(1) First, the first step latch circuits L11 to L140 latch the 40 image data read from the memory addresses 2559, 2495, . . . , 63, in regular sequence. After that, the same 40 image data as latched in the first step latch circuits L11 to L140 are simultaneously latched in the second step latch circuits L21 to L240.

(2) Second, the image data latched in the second step latch circuits L21 to L240 are compared with a reference comparison data "0" transmitted from the comparison data generation counter 16 in the PNM circuits PNM1 to PNM40. The image data is converted to binary image signals in such a way that when the image data is larger than the comparison data, the image data is converted to "1", while when the image data is smaller than the comparison data, the image data is converted to "0". The binary image signals are transmitted to the head memories M1 to M5 and memorized therein.

(3) Third, the image data latched in the second step latch circuits L21 to L240 are compared with a reference comparison data "1" transmitted from the comparison data generation counter 16 in the PNM circuits PNM1 to PNM40. The image data is converted to binary image signals in such a way that when the image data is larger than the comparison data, the image data is converted to "1", while when the image data is smaller than the comparison data, the image data is converted to "0". The binary image signals are transmitted to the head memories M1 to M5 and memorized therein.

(4) Fourth, the image data latched in the second step latch circuits L21 to L240 are compared with a reference comparison data "128" transmitted from the comparison data generation counter 16 in the PNM circuits PNM1 to PNM40. The image data is converted to binary image signals in such a way that when the image data is larger than the comparison data, the image data is converted to "1", while when the image data is smaller than the comparison data, the image data is converted to "0". The binary image signals are transmitted to the head memories M1 to M5 and memorized therein.

Figure 3:
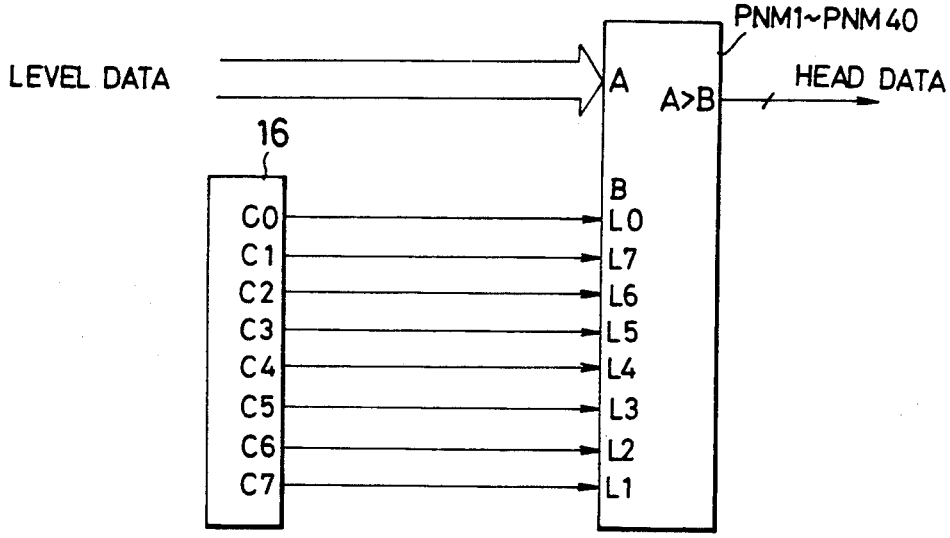
FIG. 3 is a block diagram representing a relation between a PNM circuit and the comparison data generation counter of FIG. 1.

In accordance with the above-mentioned embodiment of the invention, as represented in FIG. 3, the bit arrangement of the comparison data transmitted from the comparison data ganeration counter 16 is changed in such a way that the least significant bit (LSB) and the most significant bit (MSB) are reversed each other. The reversed bit signals of the comparison data are transmitted to the PNM circuits PNM1 to PNM40.

Figure 4:
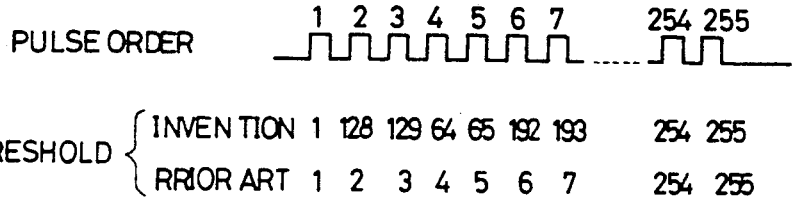
FIG. 4 is an explanatory diagram for explaining a relation between the embodiment of FIG. 1 and a prior art apparatus representing a comparison data of the relation therebetween.

Therefore, as illustrated in FIG. 4, the threshold levels of the comparison data are arranged in an irregular sequence as "1", "128", "129", "64", "65", "192", "193", . . . , "255". This is in contrast to the arrangement of prior art wherein the threshold levels are arranged in a regular sequence as "1", "2", "3", "4", "5", "6", "7", . . . , as illustrated in FIG. 4.

Figure 7:
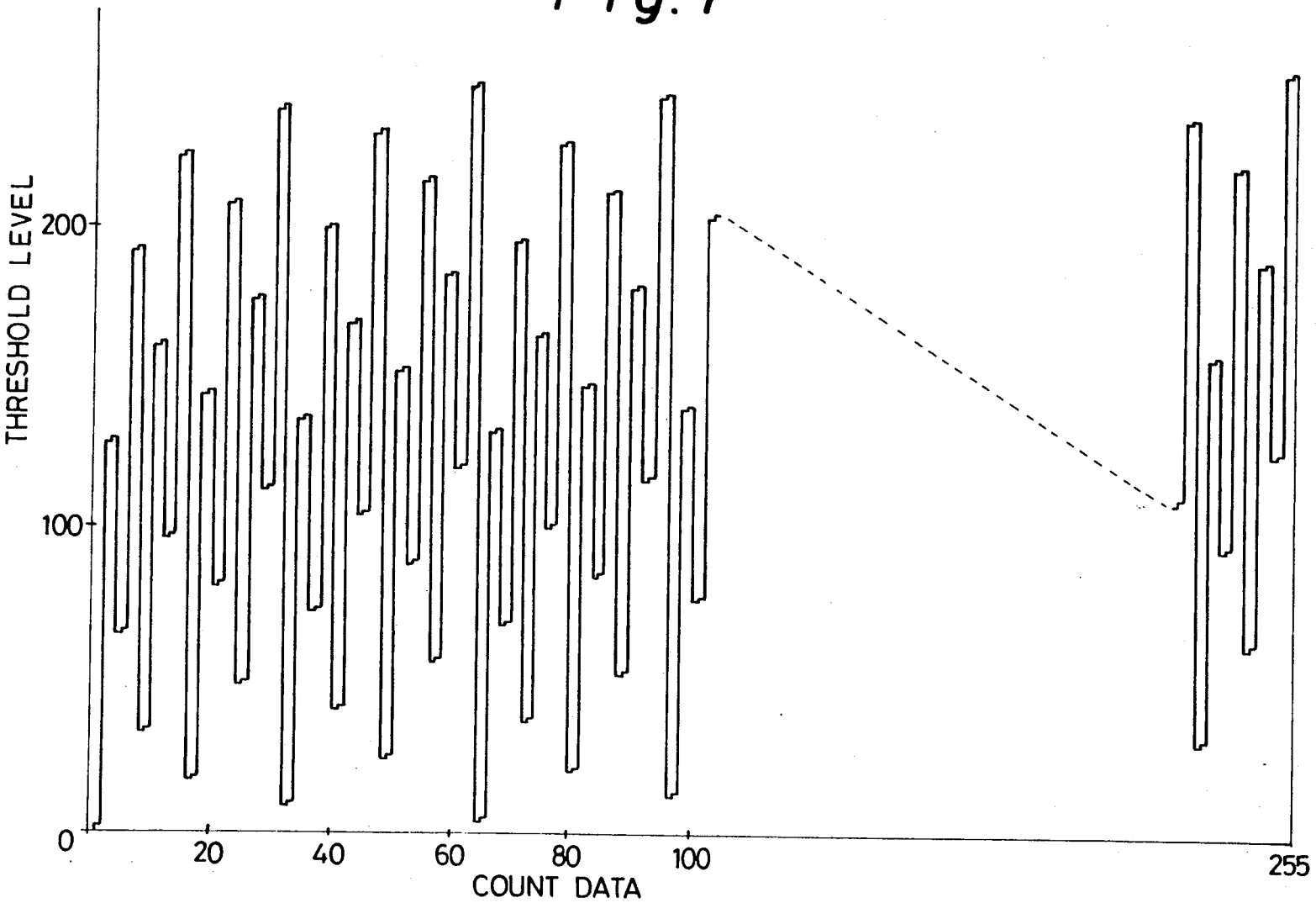
FIG. 7 is a graphical diagram representing changes of the comparison data of the embodiment of FIG. 1.

FIG. 7 represents such a change of the comparison data.

The image data latched in the second step latch circuit L21 to L240 are then compared with the comparison data "129", "64", "65", "192", "193", . . . , "255" one after another, in the same manner as mentioned above, so that the image data is converted to binary signals which are transmitted to the head memories M1 to M5 and written therein.

In accordance with the above-mentioned sequence of function, the image data latched in the second step latch circuits L21 to L240 are converted to data of 256 gradations and memorized in the head memories M1 to M5.

The high order six bits of the address of the head memories M1 to M5 represent a dot number and the low order eight bits thereof represent a level number, i.e., a number of gradation level. With respect to the functions (1) to (4) mentioned above, the addresses of the head memories M1 to M5 are leveled "0" for the dot number and "0" to "255" for the gradation number in response to the comparison data (gradation level) output from the comparison data generation counter 16.

While the operations of (2) to (4) mentioned above are conducted, the subsequent 40 image data are read out from the addresses 2558, 2494, . . . , 62, of the line memory 12 and latched in the first step latch circuits L11 to L140 to wait for processing thereof.

When the operations of (2) to (4) mentioned above are finished, the same data as latched in the first step latch circuits L11 to L140 are simultaneously latched in the second step latch circuits L21 to L240. The dot number of the data is changed to "1". By the same operations as the above-mentioned (2) to (4) operations, the image data latched in the second step latch circuits L21 to L240 are converted to data of 256 gradations and memorized in the head memories M1 to M5.

After that, in the same manner as mentioned above, 40 image data are read out from the line memory 12 and converted to data of 256 gradations which are transmitted to the head memories M1 to M5 and memorized therein. In this case, the dot number is changed to "2" to "63" in response to the every 40 data read out from the line memory.

After that, data having a level number of "0" and a dot number of one of "0" to "63" is read out from the head memories M1 to M5 synchronously with the head latch signal LD and transmitted to the thermal head as an image data DI.

After that, data having a level number of "1" and a dot number of one of "0" to "63" is read out from the head memories M1 to M5 and transmitted to the thermal head as an image data DI. Similarly, data having a level number of one of "2" to "255" and a dot number of one of "0" to "63" are read out and transmitted to the thermal head as an image data DI.

Figure 8:
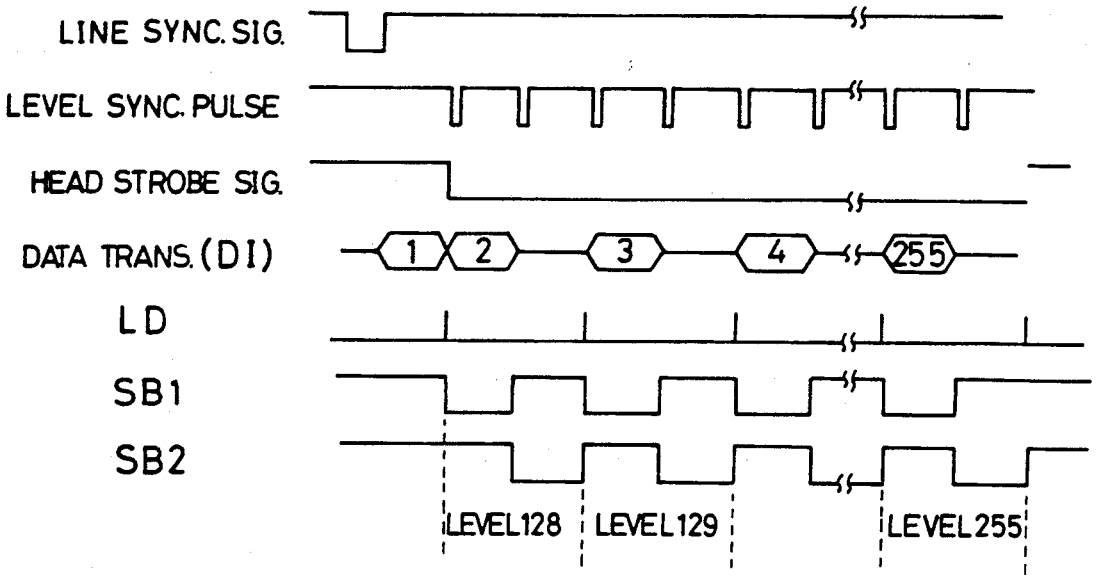
FIG. 8 is a timing chart of functions of the embodiment of FIG. 1.

FIG. 8 represents timing of the above-mentioned function.

Each of the head memories M1 to M5 is divided to two areas of 64×256 byte each as the line memory 12. The two areas are interchanged by a line sychronizing signal.

Figure 9:
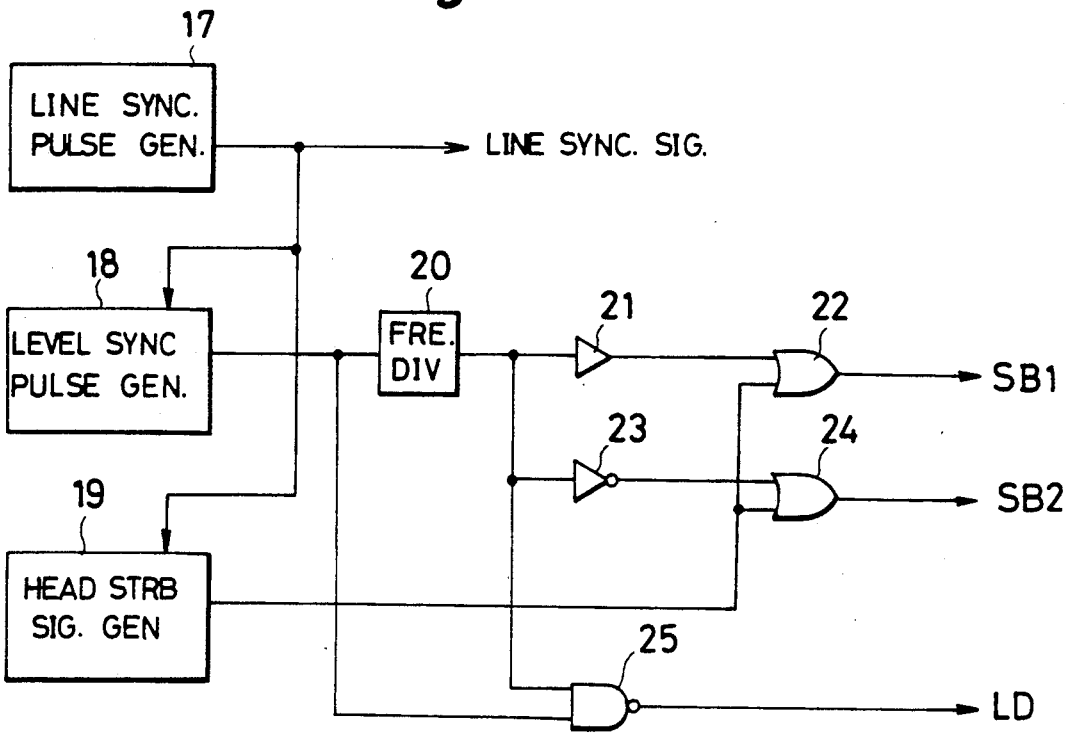
FIG. 9 is a block diagram for representing a pulse width control timer circuit of the embodiment of FIG. 1.

FIG. 9 illustrates a pulse width control timer arranged in the above-mentioned embodiment.

A line synchronizing pulse generator 17 generates line synchronizing signals. A level synchronizing pulse generator 18 generates level synchronizing pulses at an interval of time t for applying the pulse to each block of the heating resistor elements $R_1$ to $R_{2560}$ of the thermal head.

A head strobe signal generator 19 generates pulse supply enabling signals in each of the gradation levels of "1" to "255". The line synchronizing signal from the line synchronizing pulse generator 17 resets the level synchronizing pulse generator 18 and the head strobe signal generator 19. The frequency of the output signal from the level synchronizing pulse generator 18 is demultiplied to a half of the frequency by a half frequency divider 20 and transmitted to an OR circuit 22 through a buffer 21 as well as the output signal from the head strobe signal generator 19. Also, the output signal from the half frequency divider 20 is reversed by an inverter 23 and transmitted to an OR circuit 24 as well as the output signal from the head strobe signal generator 19.

The output signal from the OR circuit 22 is transmitted to the thermal head as a strobe pulse SB1 for selecting the first group of heating resistor elements $R_1$, $R_3$, . . . , $R_{2559}$. Also, the output signal from the OR circuit 24 is transmitted to the thermal head as a strobe pulse SB2 for selecting the second group of heating resister elements $R_2$, $R_4$, . . . , $R_{2560}$.

The output signals from the level synchronizing pulse generator 18 and the half frequency divider 20 are transmitted to a NAND circuit 25. The output signal from the NAND circuit 25 is transmitted to the thermal head as a head latch signal LD.

Figure 10:
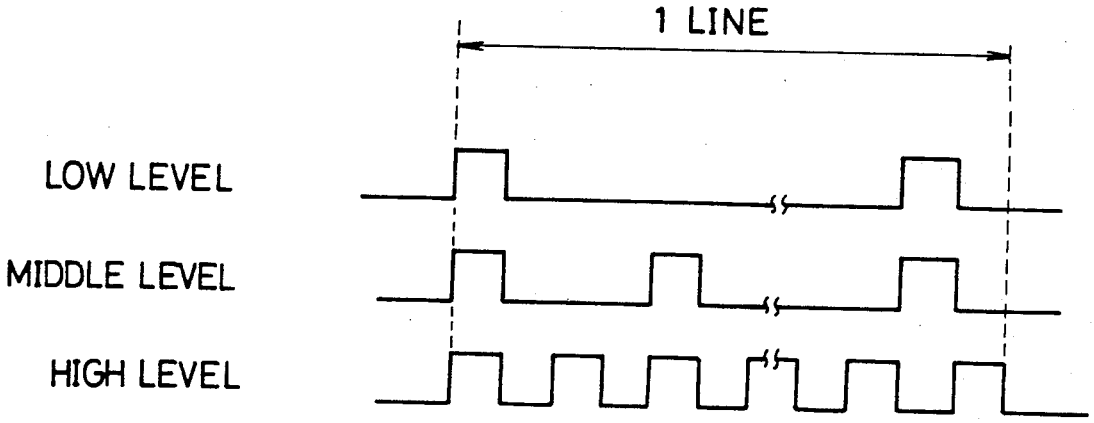
FIG. 10 is an explanatory diagram for representing waveforms of pulses of three levels applied to the heating resistor elements of the embodiment of FIG. 1.

In accordance with the above-mentioned embodiment, the comparison data transmitted from the comparison data generation counter 16 changes as illustrated in FIG. 7, which has an effect of diffusing a plurality of dots applied to each of the heating resistor elements $R_1$ to $R_{2560}$ almost evenly at a regular interval within a time range for recording one line of the image in response to the image data, as illustrated in FIG. 10. This is unlike the high density pulses of prior art.

By the arrangement of the present invention mentioned above, the center point of each dot is kept unchanged at a same position and the image frequency becomes low, which upgrades the quality of the record image. Besides, it becomes unnecessary to rise the temperature of the heating resistor elements, which obviates the problems resulted from the high temperature of the heating resistor elements as mentioned before.

Figure 15:
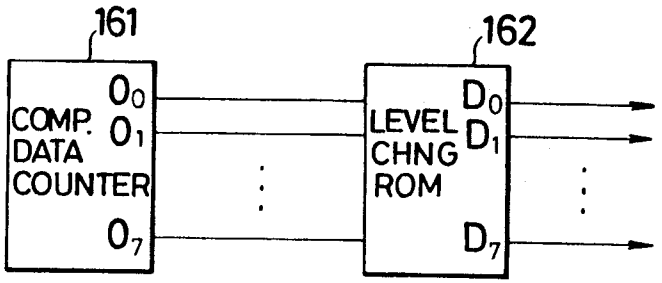
FIG. 15 is a block diagram for representing a construction of a comparison data generation counter in accordance with another embodiment of the present invention.

FIG. 15 illustrates another example of the comparison data generation counter in accordance with another embodiment of the present invention.

This embodiment comprises a comparison data generation counter 16 comprising a counter 161 for comparison data and a read only memory (ROM) 162 for changing level, as illustrated in FIG. 15. The comparison data counter 161 counts the clock so that the count number changes in sequence from 0 to 254.

Figure 17:
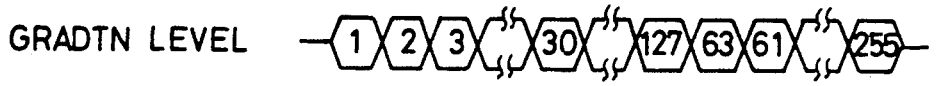
FIG. 17 is an explanatory diagram for explaining changes of the comparison data in the second embodiment.

The level changing ROM 162 reads out the data from the address indicated by the count number of the counter 161 and outputs the count number of the counter 161 as it is from 0 to 30 as illustrated in FIG. 17. Whereas the count numbers from 31 to 254 are diffused evenly at about regular intervals and transmitted to the PNM circuits PNM1 to PNM40 as a comparison data. Thereby, the gradation level is increased in sequence to 30, as illustrated in FIG. 17, and evenly arranged at about regular intervals from 31. The comparison data transmitted to the PNM circuits PNM1 to PNM40 has a threshold level which increases regularly in sequence with respect to the data of "1" to "30", whereas becomes irregular with respect to the data of "31" to "255".

Figure 16:
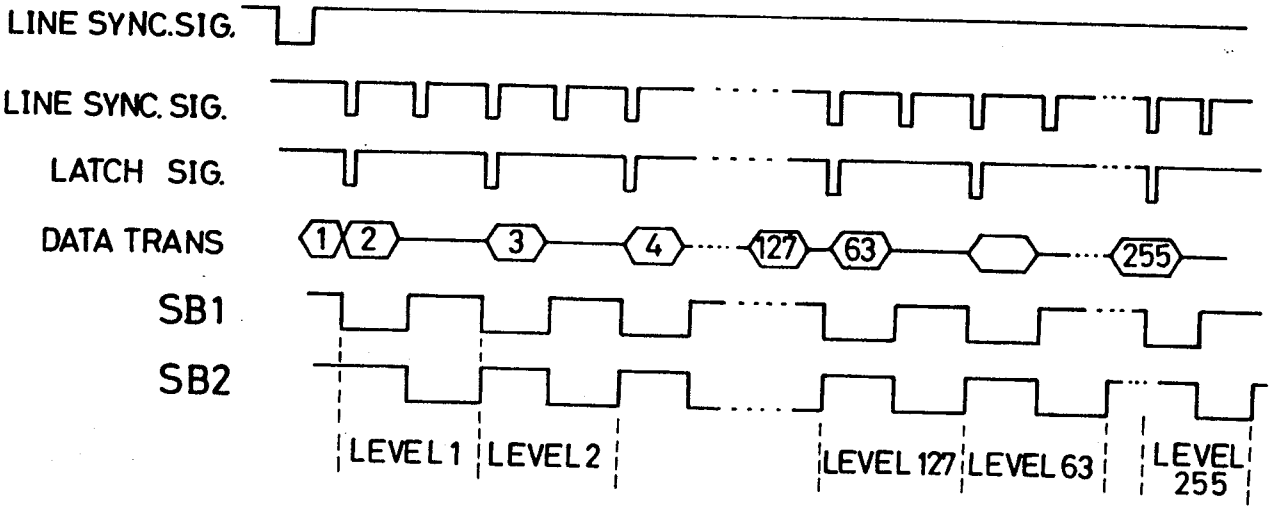
FIG. 16 is a timing chart for representing a function of the second embodiment.

The timing chart of the function of the above-mentioned embodiment is represented in FIG. 16.

Figure 19A:
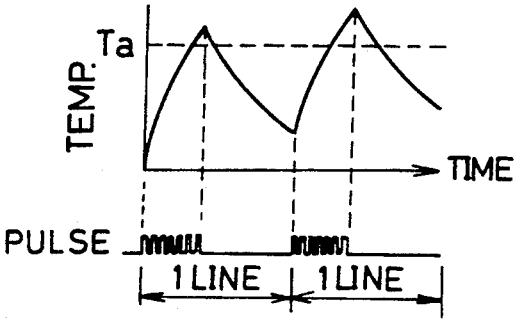
FIG. 19*a* is a graphical view for representing a temperature characteristic of the thermal head in accordance with the prior art.
Figure 19B:
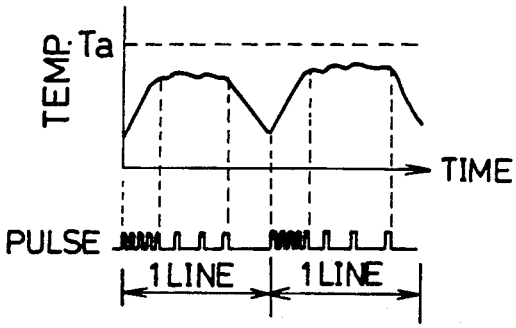
FIG. 19*b* is a graphical view for representing a temperature characteristic of the thermal head in accordance with the present invention.
Figure 20:
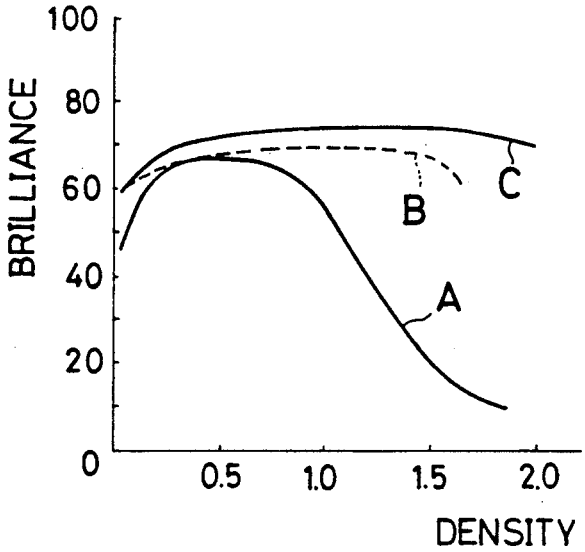
FIG. 20 is a graphical view for representing a relation between luster and record image density of the present invention in comparison to the prior art.

FIGS. 19*a* and 19*b* graphically illustrate a temperature characteristic of the prior art appararus and the above-mentioned embodiment of the present invention, respectively. Also, FIG. 20 is a graphical view of image brilliance in relation to the printing density regarding the prior art apparatus and the embodiment of the present invention.

In accordance with the prior art apparatus, a plurality of pulses are continuously applied in sequence to each dot of the heating resistor elements, which results in that the temperature of the heating resistor elements increases rapidly and exceeds the critical temperature Ta allowable for quality change of the print paper, as illustrated in FIG. 19*a*. Also, the image brilliance of the prior art apparatus is degraded in a high density range of printing, as represented by the characteristic lines A and B of the graph of FIG. 20.

On the other hand, in accordance with the embodiment of the present invention mentioned above, a plurality of pulses are applied to each dot of the heating resistor elements in such a way that in a former part of the printing time for printing one line of the image, the pulses are densely applied, while in a latter part of the printing time, the pulses are diffused and sparsely applied. Therefore, the temperature of the heating resistor elements does not exceed the critical temperature Ta allowable for quality change of the print paper, as can be seen from the graph of FIG. 19*b*. Also, the image brilliance is not degraded in a high density range of printing, as can be seen from the characteristic line C of the graph of FIG. 20.

Figure 18:
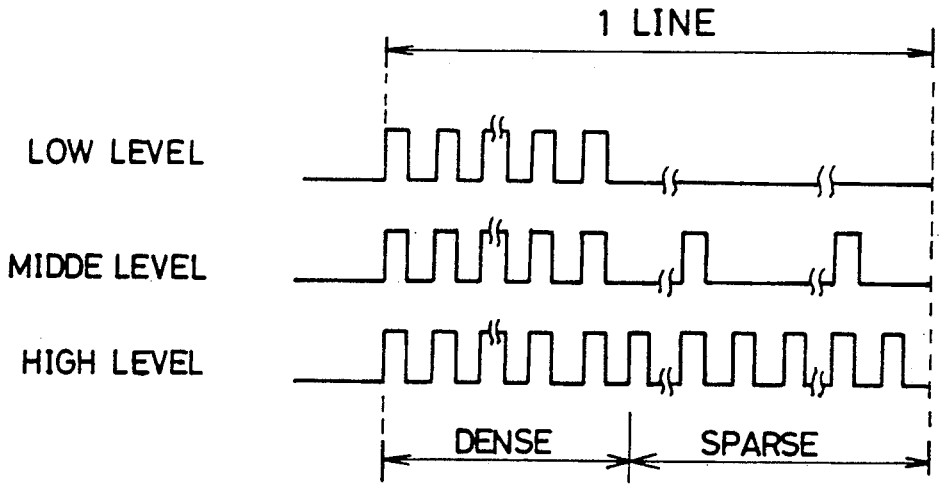
FIG. 18 is a graphical view for representing waveforms of pulses of three levels applied to the heating resistor elements of the second embodiment.

In accordance with the embodiment of the present invention mentioned above, the comparison data transmitted from the comparison data generation counter 16 increases regularly in sequence from 0 to 30, while the data of 31 to 254 are diffused evenly at about regular intervals. Therefore, as represented in FIG. 18, a plurality of pulses applied to each dot of the heating resistor elements $R_1$ to $R_{2560}$ are arranged in such a way that in a former part of the image record time for recording one line of the image, the pulse data increases in sequence to 30, while in a latter part of the image record time, the pulse data from 31 to 254 are evenly diffused and distributed over the latter part of the time range. This is in contrast to the prior art wherein the whole data is arranged continuously in sequence.

By the above-mentioned arrangement of the embodiment of the present invention, the center point of each dot is kept unchanged at a same position and the image frequency becomes low, which upgrades the quality of the image. Besides, it becomes unnecessary to rise the temperature of the heating resistor elements, which obviates the problems caused from the high temperature of the heating resister elements mentioned before.

Figure 26:
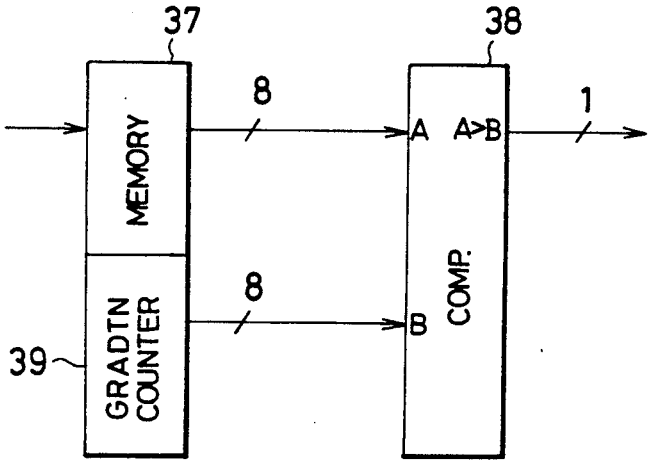
FIG. 26 is a block diagram of a part of another embodiment of the present invention.
Figure 27:
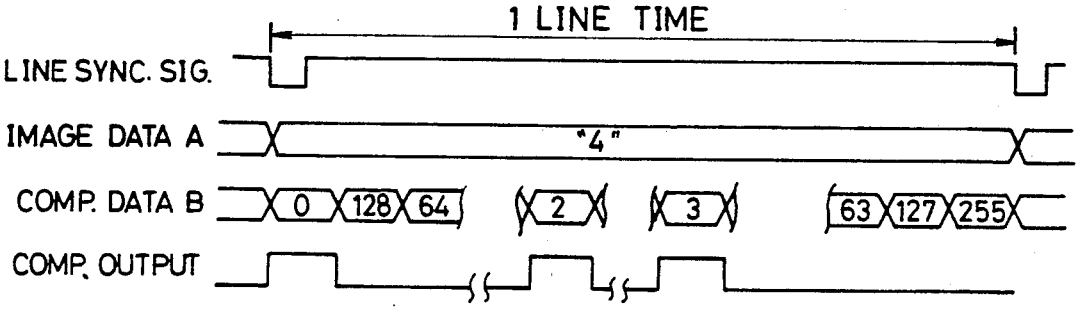
FIG. 27 is a timing chart of the embodiment of FIG. 26.

FIG. 26 illustrates still another embodiment of the present invention and FIG. 27 illustrates a timing chart of the embodiment of FIG. 26.

This embodiment represents a current applying and transferring type printer which comprises a current applying and transferring head. The head comprises a recording unit comprising a plurality of recording electrodes and common electrodes disposed in one row for recording one line of an image. The recording electrodes and common electrodes are made come in contact with an ink sheet comprising a resistance layer, a conductive layer and an ink layer.

The image data for each line is written in a memory 37 in sequence line by line. The image data A output from the memory 37 is transmitted to a comparator 38 and compared with each gradation data B transmitted from a gradation counter 39. When the data A is larger than the data B, a pulse signal is transmitted from the gradation counter 39 to the current applying and transferring head.

The gradation counter 39 is connected to the comparator 38 in such a way that the most significant bit and the least significant bit are reversed each other as in the case of the comparator data generation counter 16 mentioned before so that a gradation data which changes as represented in FIG. 7 is transmitted to the comparator 38. The output pulses from the comparator 38 are evenly dispersed at about regular intervals in an image recording time for recording one line of a picture element.

In the current applying and image transferring head, the pulses from the comparator 38 are applied between the plurality of recording electrodes and the common electrodes so that the ink sheet is supplied with the current from the recording electrodes and the common electrodes so that Joule heat is generated from the resistance layer of the ink sheet. Due to this Joule heat, the ink is transferred from the ink layer to the record paper to record an image thereon.

The ink sheet and the record paper are carried by a driving means so that the image is recorded on the paper line by line.

Figure 25A:
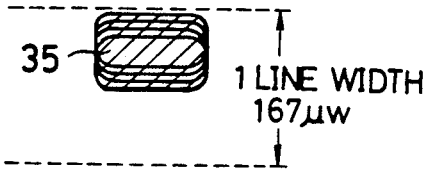
FIG. 25*a* is an explanatory view for explaining a state of recording using the picture element in accordance with the prior art.

In accordance with the prior art apparatus, a small picture element 35 is recorded in a low density portion of the image, as illustrated in FIG. 25*a*.

Figure 25B:
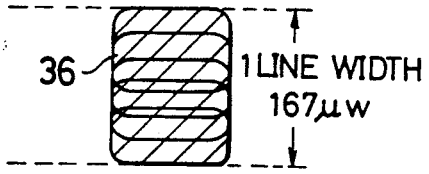
FIG. 25*b* is an explanatory view for explaining a state of recording using the picture element in accordance with the present invention.

On the other hand, in accordance with the embodiment of the invention mentioned above, a plurality of pulses are applied to between the recording electrodes and the common electrodes for each line of one picture element in such a way that the pulses are dispersed evenly in the recording time for recording one line of the picture element. Therefore, a large picture element 36 is recorded, as illustrated in FIG. 25*b*. The size of the picture element 36 of low density is approximately the same as that of the one which is formed in the high density portion. Therefore, the white ground portion of low density in the record image is not overly stressed, which results in a high quality of image.

It is to be noted that in the above-mentioned embodiment of the present invention, the gradation counter 39 may comprise a counter which count up the number of the output data in sequence and a level changing ROM circuit for changing the output data to the predetermined data as mentioned above.

Many widely different embodiments of the present invention may be constructed without departing from the spirit and scope of the present invention. It should be understood that the present invention is not limited to the specific embodiments described in the specification, except as defined in the appended claims.

What is claimed is:

1. A thermal recording apparatus for recording an image with gradation comprising:

a recording head including a plurality of heating elements disposed in one line, each of said heating elements forming a respective dot;

pulse applying means for applying a plurality of pulses during an image record time interval to each of said heating elements to cause the heating elements to form respective dots having different gradation level according to an image data;

heat value control means for controlling a heat value generated by each of said heating elements by varying a number of the pulses to be applied to the heating elements during the image record time interval according to a density parameter of the respective dots;

means for distributing said pulses to be applied to each of the heating elements during the image record time interval, including control means for controlling said pulse applying means in such a manner that a respective predetermined number of pulses are applied to each of said heating elements during an early predetermined time interval which is at an early part of the image record time interval and the rest of the pulses are applied to each of said heating elements substantially in a later predetermined time interval which is at a later part of the image record time interval and has a duration which is not less than that of said early predetermined time interval and such that the rest of the pulses are distributed in a latter part of the image record time.

2. A recording apparatus according to claim 1, wherein the number of pulses to be applied in said early predetermine time interval is equal to the number of pulses for recording a lowest density dot.

3. A recording apparatus according to claim 1, wherein the control means comprises means for generating threshold data in such a manner that said threshold data changes regularly in said early predetermined time interval and changes irregularly in said later predetermined time interval, and further comprises a comparator for comparing image data with the threshold data.

4. A recording appartus according to claim 3, wherein the generating means comprises a counter for counting up by a predetermined value and a data conversion table for converting said counted value to said threshold data.

5. A recording apparatus according to claim 1, wherein said heating element includes a resistor energized by applying a voltage signal thereto.

6. A recording apparatus according to claim 1, wherein said heating element includes a recording electrode for applying a voltage to a resistance layer on a recording medium.

* * * * *